United States Patent [19]

Longoria

[11] Patent Number: 5,018,304

[45] Date of Patent: May 28, 1991

[54] DOOR OPERATOR

[75] Inventor: Ritchie L. Longoria, Germantown, Tenn.

[73] Assignee: F. L. Saino Manufacturing Co., Memphis, Tenn.

[21] Appl. No.: 521,437

[22] Filed: May 10, 1990

[51] Int. Cl.[5] ..... E05F 15/10

[52] U.S. Cl. ..... 49/340; 49/26

[58] Field of Search ..... 49/340, 26, 27, 28, 49/334, 324, 138, 139

[56] References Cited

U.S. PATENT DOCUMENTS

| | | | |
|---|---|---|---|
| 581,972 | 5/1897 | Wright | 49/340 X |
| 1,544,901 | 7/1925 | Griffin | 49/28 X |
| 2,757,327 | 7/1956 | Oliver | 49/28 X |
| 2,843,376 | 7/1958 | Osuch et al. | 49/26 X |
| 3,237,932 | 3/1966 | Catlett | 49/334 X |
| 3,284,950 | 11/1966 | Gute | 49/28 |
| 3,874,117 | 4/1975 | Boehm | 49/340 X |
| 4,289,995 | 9/1981 | Sorber et al. | 49/334 X |
| 4,599,824 | 7/1986 | Mitsuhashi et al. | 49/334 X |
| 4,750,295 | 6/1988 | Court et al. | 49/340 |
| 4,782,628 | 11/1988 | Gaddis | 49/340 |

OTHER PUBLICATIONS 1 page entitled "Swing-Door", Richards Wilcox Catalog A-210 R6 (1961), p. 14.

*Primary Examiner*—Philip C. Kannan

*Attorney, Agent, or Firm*—Walker & McKenzie

[57] ABSTRACT

An operator for moving a door between an open position and a closed position. The operator includes linkage for being attached to the door; a motor assembly having a drive shaft; and a drive train for coupling the drive shaft of the motor assembly to the linkage structure, the drive train includes a clutch for selectively disconnecting the linkage from the drive shaft of the motor assembly and a variable torque control assembly for varying the torque produced by the clutch.

14 Claims, 2 Drawing Sheets

DOOR OPERATOR

BACKGROUND OF THE INVENTION

1. Field of the Invention

The present invention relates, in general, to door operators for opening and closing doors.

2. Information Disclosure Statement

Various door operators have been developed for opening and closing swing-type doors and the like. The typical door operator includes a motor, linkage means for coupling the drive shaft of the motor to a door so that the door will be opened and closed when the drive shaft rotates, and control means for activating the motor when it is desired to open or close the door. The control means may include various switch means such as, for example, pressure activated floor switches, ultrasonic presence sensors, motion sensors, radio transmitters, wall switches, etc. Such control means may also include speed control means for controlling the speed of the motor, limit means for controlling the amount of movement of the door, logic means for controlling the direction of the door is moved, etc. Richards Wilcox of 174 Third St., Aurora, IL has manufactured a swing door operator (Model 1501) that includes an operator unit having a motor, belt drive, and safety clutch for being mounted to the face of the door to be opened, and that includes linkage for extending from the operator unit to the wall adjacent the door.

Problems occur with prior art door operators when the door to be opened and/or closed is extremely heavy (such as explosion resistant doors or lead lined radiation resistant doors used in cancer treatment clinics, etc.), is subjected to high pressure differentials, or is subjected to high winds, etc. More specifically, due to the heavy weight of certain doors or the high pressure that must be overcome to open and/or close certain doors, prior door operators designed for use with such doors use substantial force to open and/or close such doors to overcome the heavy weight and high pressure required. However, such force affects the life of the door and associated structure (i.e., the force used places substantial stress on the doors and associated structure), and creates unsafe conditions (e.g., the force at which the doors are opened and/or closed can injure persons passing therethrough, etc.).

The prior art does not disclose or suggest the present invention. More specifically, the prior art does not disclose or suggest a door operator including linkage for being attached to a door; a motor having a drive shaft; and a drive train for coupling the drive shaft of the motor to the linkage, the drive train including a clutch for selectively disconnecting the linkage from the drive shaft of the motor and variable torque control means for varying the torque produced by the clutch means.

SUMMARY OF THE INVENTION

The present invention is directed toward providing an improved door operator. The concept of the present invention is to combine a clutch with a motor assembly and linkage of a door operator to allow the linkage to be selectively disconnected from the motor assembly and to allow the force at which the door is opened and/or closed to be carefully controlled.

The operator of the present invention includes linkage for being attached to a door; a motor assembly having a drive shaft; and a drive train for coupling the drive shaft of the motor assembly to the linkage, the drive train including a clutch for selectively disconnecting the linkage from the drive shaft of the motor assembly and variable torque control means for varying the torque produced by the clutch.

DESCRIPTION OF THE PREFERRED EMBODIMENT

Figure 1:
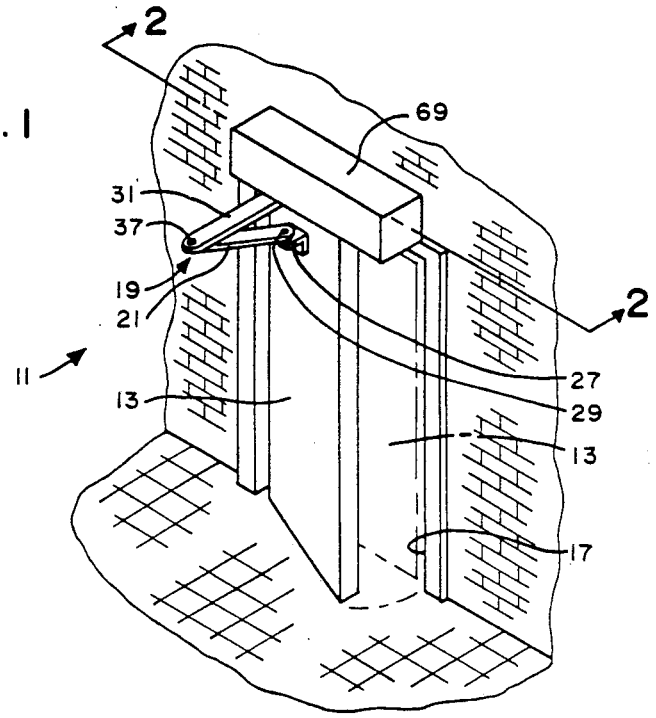
FIG. 1 is a perspective view of the door operator of the present invention combined with a swinging door.

The preferred embodiment of the door operator 11 of the present invention is used in combination with a swing-type door 13 to power open and power close the door 13. The operator 11 is especially designed for difficult situations caused by heavy doors (e.g., lead-lined radiation doors), windy conditions, stack pressure, negative plant pressure, tight seals for radio frequency doors, etc. As shown in FIG. 1, the door 13 is swingably mounted to a wall 15 for movement between an open position as shown in solid lines in FIG. 1 and a closed position as indicated by broken lines in FIG. 1 to selectively open and close a door opening 17 through the wall 15.

Figure 2:
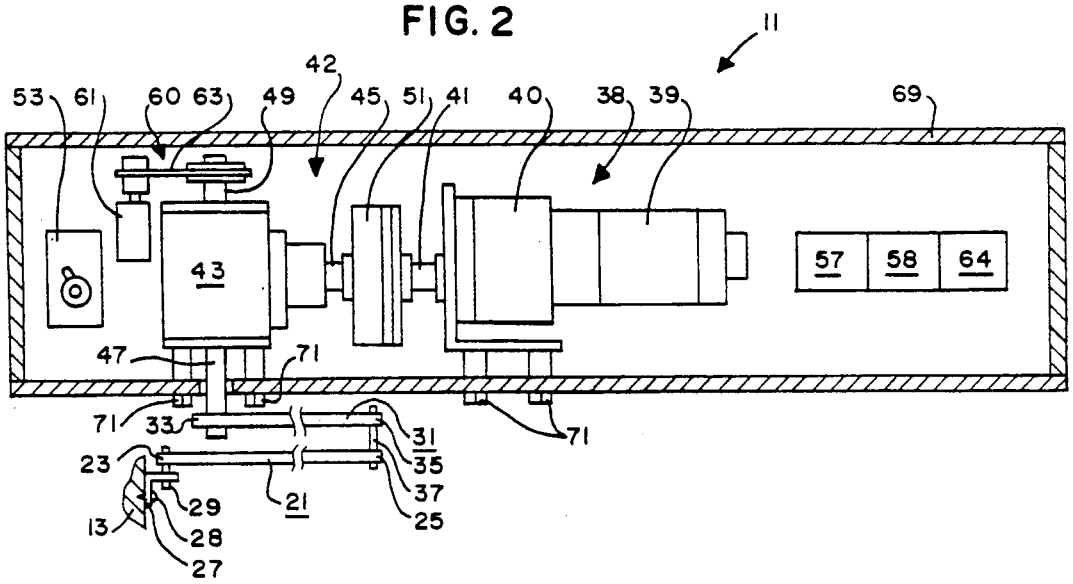
FIG. 2 is an enlarged sectional view substantially as taken on line 2—2 of FIG. 1 with certain portions broken away and omitted for clarity.

The operator 11 includes linkage means 19 for being connected to the door 13. The linkage mean 19 may be of various specific types well known to those skilled in the art. Thus, the linkage means 19 may consist of a standard lintel mounting, parallel arm linkage, or the like, as will now be apparent to those skilled in the art. As shown in FIGS. 1 and 2, the linkage means 19 may include an elongated, rigid first connecting arm 21 having a first end 23 and a second end 25, a mounting plate 27 for being fixed to the door 13 by screws 28 or the like, a first pivot 29 for pivotally joining the first end 23 of the first connecting arm 21 to the mounting plate 27, an elongated, rigid second connecting arm 31 having a first end 33 and a second end 35, and a second pivot 37 for pivotally joining the second end 25 of the first connecting arm 21 to the second end 35 of the second connecting arm 31. Rotation of the first end 33 of the second connecting arm 31 will cause the door 13 to swing between the first and second positions as will now be apparent to those skilled in the art.

The operator 11 includes a motor assembly 38 for activating the linkage means 19. More specifically, the motor assembly 38 causes the first end 33 of the second connecting arm 31 to rotate to thereby cause the door 13 to swing between the first and second positions. The motor assembly preferably includes a motor 39. The motor 39 is preferably a 90 volt, ½ horsepower, direct current permanent magnet type electric motor such as, e.g., part #108116-00 manufactured by Leeson Electric of Grafton, WI 53024-0241. An input gearhead 40 may be attached to the drive shaft of the motor 39 for increasing the torque produced by the motor 39. For example, the gearhead 40 may have a drive ratio of 289-to-1 or the like to thereby substantially increase the torque produced by the motor 39 as will now be apparent to those skilled in the art. The input gearhead 40 preferably consists of a highly efficient parallel-type gearhead such as part # H3085/07 HS 289:1 manufactured by Sumitomo of 640 Wheat Ave., Woodale, IL 60191. A drive shaft extends from the gearhead 39 and defines a drive shaft 41 of the motor assembly 38.

The operator 11 includes drive train means 42 for coupling the drive shaft 41 to the linkage means 19 to cause the door 13 to move between the open position and the closed position. The drive train means 42 preferably includes gear means 43 for being driven by the motor assembly 38 and for driving the linkage means 19. More specifically, the gear means 43 preferably includes a driven shaft 45 for being coupled to the drive shaft 41, and a main drive shaft 47 for being coupled to the first end 33 of the second connecting arm 31 of the linkage means 19. The gear means 43 preferably includes a secondary drive shaft 49 for reasons which will hereinafter become apparent. The gear means 43 preferably consists of a typical right angle bevel gear assembly with a two-to-one ratio or the like for changing the direction of the drive shaft 41 of the motor assembly 38 without substantial loss in efficiency as will now be apparent to those skilled in the art. For example, the gear means 43 may be a model 150 2:1 gearhead manufactured by Hub City of P.O. Box 1089, Aberdeen, SD.

The drive train means 42 includes clutch means 51 for selectively disconnecting the linkage means 19 from the drive shaft 41 of the motor assembly 38. The clutch means 51 preferably consists of a typical electrical magnetic clutch positioned between the drive shaft 41 of the motor assembly 38 and the driven shaft 45 of the gear means 43 for disconnecting the driven shaft 45 of the gear means 43 from the drive shaft 41 of the motor assembly 38 if the torque required to move the door 13 increases above a certain amount.

Figure 3:
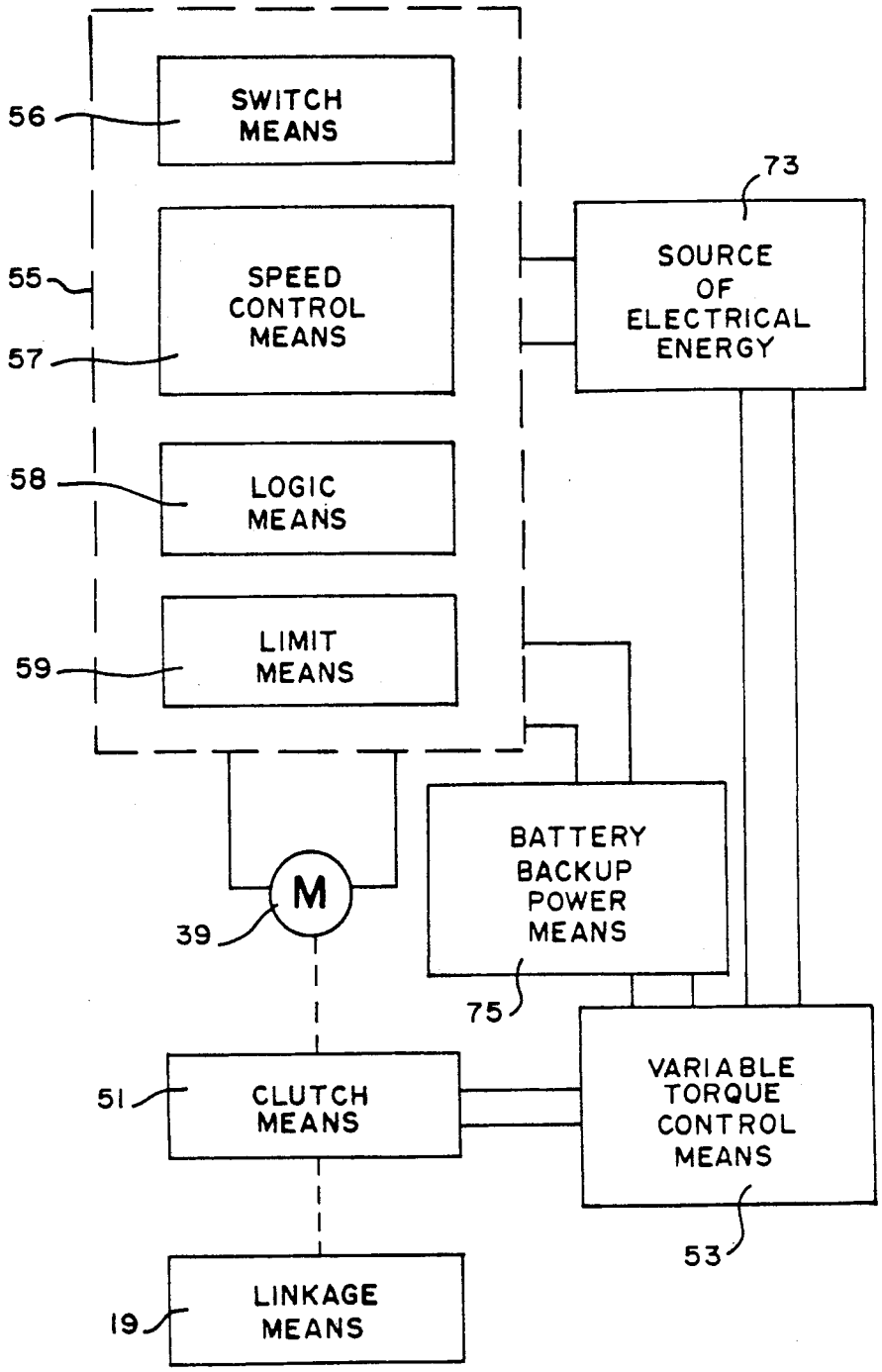
FIG. 3 is a diagrammatic view of the basic combination of the door operator of the present invention.

The operator 11 preferably includes a variable torque control means 53 for allowing the torque at which the clutch means 51 will disconnect the driven shaft 45 of the gear means 43 from the drive shaft 41 of the motor assembly 38 to be varied. The variable torque control means 53 is preferably electrically coupled to the clutch means 51 as shown diagrammatically in FIG. 3. The clutch means 51 and the variable torque control means 53 preferably consist of a "Dynatec 2600" unit manufactured by Dynacorp Inc. of 5173 26th Avenue, Rockford, IL 61109., parts #s FC-305158 and 214232 respectively.

As thus combined, the clutch means 51 disconnects the linkage means 19 from the drive shaft 41 of the motor assembly 38 when the force required to move the door 13 increases above a certain amount and the variable torque control means 53 allows that "certain" amount to be set at just enough to open and/or close the door 13 depending on the specific conditions present (e.g., the weight of the door 13, the pressure differential between opposite sides of the door 13, etc.) so that whenever something causes the force required to move the door 13 to be greater than that "certain" amount (e.g., when the door 13 reaches the fully closed or fully open position or when the door 13 strikes a person or object While moVing between the open and closed positions, etc.), the clutch means 51 will start to slip and effectively disconnect the linkage means 19 from the motor 39 as will now be apparent to those skilled in the art.

The operator 11 preferably includes control means 55 for controlling the motor 39. The control means 55 may consist simply of a switch means 56 for controlling the passage of electrical energy to the motor 39. The switch means 56 may be of various specific types as will now be apparent to those skilled in the art. Thus, for example, the switch means 56 may consist simply of a manual lever or push-button type wall switch for being mounted on the wall 15 adjacent the door 13 to allow a person wanting to open or close the door 13 to merely open or close the manual switch. However, the switch means 56 may consist of a typical in-floor pressure switch, an ultrasonic presence sensor switch, an infrared motion sensor switch, a radio transmitter switch, etc., as will now be apparent to those skilled in the art.

The control means 55 preferably includes electronic control assemblies and additional features for controlling the speed of the motor 39, providing diagnostics for easy servicing and trouble shooting of the operator 11, providing electronic braking for smoothing stopping of the door 13, limiting the swing of the door 13, etc., in the same manner provided by prior art swinging door operators and the like. For example, the control means 55 preferably includes speed control means 57 for controlling the speed of the motor 39. The speed control means 57 may consist simply of a variable resistor or the like but preferably consists of a speed control board such as part # RG51UA manufactured by Minerick of 901 E. Thompson Ave., Glendale, CA 91201-2011. The control means also preferably includes logic means 58 for controlling the direction of rotations of the drive shaft 41, when the motor 39 is activated, etc., as will now be apparent to those skilled in the art. The logic means 58 may consist of a logic board such as part # 1900 MB manufactured by F.L. Saino Mfg. Co. of 66 West Colorado Ave., Memphis, TN 38106.

The control means 55 preferably includes limit means 59 for limiting the swing of the door 13 between the open position and the closed position. The limit means 59 preferably includes a limit assembly 60. The limit assembly 60 preferably includes a rotary limit switch 61 coupled to the secondary drive shaft 49 of the gear means 43 by means of a chain drive 63 (See FIG. 2) so that the swing of the door 13 between the open position and the closed position can be limited and the relative position of the door 13 with respect to the open position and the closed position can be monitored, etc., as will now be apparent to those skilled in the art. More specifically, the rotary limit switch 61 may be adapted to reverse or stop the rotation of the drive shaft 41 of the motor assembly 38 after the door 13 has swung a certain amount from the closed position to the open position as will now be apparent to those skilled in the art. The limit assembly 60 may consist of part # SX-LS Assy-4 manufactured by Landert of Bulach, Switzerland. The limit means 59 also preferably includes a limit board 64 for controlling the output of the limit switch 61. For example, when the limit switch 61 closes due to the door 13 swinging a certain distance, the limit board 64 may energize a light or the like to signal that the door is open, and may then direct the logic means to close the door 13 after a certain period of time, etc., as will now be apparent to those skilled in the art. The limit board 64 may consist of part # 1900 LB manufactured by F.L. Saino Mfg. Co. of 66 West Colorado Ave., Memphis, TN 38106.

The operator 11 may include a box-like housing member 69 for being attached to the wall 15 above the door 13 and for housing the motor 39, drive train means 42, and control means 55. More specifically, the housing member 69 is preferably mounted above the door 13 on the lintel of the door frame by wall mounting bolts (not shown). The motor assembly 38 and gear means 43 may be fixedly attached to the housing by bolts 71 or the like. Various other components of the operator 11, including the variable torque control means 53, speed control means 57, and rotary limit switch 61 are preferably fixedly mounted within the interior of the box member 69 by bolts or the like (not shown) as will now be apparent to those skilled in the art. The housing member 69 is preferably constructed out of metal or the like with portions thereof removable to allow access to the interior thereof.

The operator 11 includes a electric circuit for providing a pathway between a source 73 of alternating current electrical energy electrical energy (shown diagrammatically in FIG. 3 with electrical conductors extending between the variable torque control means 53, the control means 55, and the source 73 of electrical energy), and the various electrical components. The electric circuit preferably includes a transformer for providing low voltage electrical energy to certain components of the control means 55, a 24 VAC P/B heavy duty relay for controlling the passage of electrical energy to the motor 39. The operator 11 preferably includes battery backup power means 75 (shown diagrammatically in FIG. 3 with electrical conductors extending between the variable torque control means 53, the control means 55, and the battery backup power means 75) for operating the motor 39 and clutch means 51 in the event of an electrical energy failure, etc., as will now be apparent to those skilled in the art. The transformer may consist of part # ZA-120-24 manufactured by Dayton of Troy, Ohio. The battery backup power means 75 may consist of a model "Dynasty" battery backup system manufactured by Johnson Controls of Albany, NY including part # JC 12-60 (battery charger) and part # JC 670 (battery). The specific wiring of the electric circuit will now be apparent to those of ordinary skill in the art.

The specific construction of the operator 11 may vary but should be heavy-duty to handle the loads of heavy doors, wind loads, etc. As thus constructed and used, the present invention provides the combination of a variable speed DC motor drive, variable torque clutch, bevel gear and heavy duty construction to provide a power open and power close operator to handle the load of heavy doors, wind loads, etc., without causing damage to the door and adjacent structure and without creating a safety hazard.

Although the present invention has been described and illustrated with respect to a preferred embodiment and a preferred use therefor, it is not to be so limited since modifications and changes can be made therein which are within the full intended scope of the invention.

I claim:

1. An operator for use in combination with a source of electrical energy and for moving a door between an open position and a closed position in difficult situations caused by heavy doors, windy conditions, stack pressure, negative plant pressures, tight seals, etc., said operator comprising:

(a) linkage means for being attached to said door;

(b) a motor assembly for being coupled to said source of electrical energy, said motor assembly having a drive shaft; and (c) drive train means for coupling said drive shaft of said motor assembly to said linkage means and for allowing said motor assembly to move said door to said open position and to said closed position under power, said drive train means including an electrical mechanical clutch means for being coupled to said source of electrical energy for being activated when electrical energy passes from said source of electrical energy to said clutch means and for selectively disconnecting said linkage means from said drive shaft of said motor assembly if the torque required to move said door between said open and closed positions increases above a certain amount for completely disconnecting said linkage means from aid drive shft of said motor assembly in the event not electrical energy passes from said source of electrical energy to said clutch means, said drive train means including variable torque control means for varying said certain amount of torque required before said clutch means disconnects said linkage means from said drive shaft of said motor assembly.

2. The operator of claim 1 in which said drive train means includes gear means for being driven by said motor assembly and for driving said linkage means.

3. The operator of claim 2 in which said gear means includes a driven shaft for being coupled to said drive shaft of said motor assembly, and a main drive shaft for being coupled to said linkage means.

4. The operator of claim 3 in which said linkage means includes an elongated, rigid first connecting arm having a first end and a second end, a mounting plate for being fixed to said door, a first pivot for pivotally joining said first end of said first connecting arm to said mounting plate, an elongated, rigid second connecting arm having a first end and a second end, and a second pivot for pivotally joining said second end of said first connecting arm to said second end of said second connecting arm.

5. The operator of claim 4 in which said main drive shaft of said gear means is connected to said first end of said second connecting arm of said linkage means.

6. The operator of claim 4 in which is included control means for controlling said motor assembly and for providing electronic braking for smoothing stopping of said door.

7. The operator of claim 6 in which said control means includes variable speed control means for controlling the speed of said motor assembly.

8. The operator of claim 7 in which said control means includes limit means for limiting the swing of said door between the open position and the closed position.

9. The operator of claim 8 in which said gear means includes a secondary drive shaft, and in which said limit means includes a rotary limit switch coupled to said secondary drive shaft of said gear means so that the swing of said door between the open position and the closed position can be limited and the relative position of said door with respect to the open position and the closed position can be monitored.

10. The operator of claim 9 in which said rotary limit switch is adapted to reverse or stop the rotation of said drive shaft of said motor assembly after said door has swung a certain amount from the closed position to the open position.

11. The combination with a door movable between an open position and a closed position and a source of electrical energy, of a power open, power close operator for moving said door between said open position and said closed position in difficult situations caused by heavy doors, windy conditions, stack pressure, negative plant pressures, tight seals, etc., said operator comprising:

(a) linkage attached to said door;

(b) a motor assembly coupled to said source of electrical energy for being powered when electrical energy passes from said source of electrical energy to said motor assembly, said motor assembly having a drive shaft; and (c) a drive train coupling said drive shaft of said motor assembly to said linkage and allowing said motor assembly to move said door to said open position and to said closed position under power, said drive train including an electrical mechanical clutch means coupled to said source of electrical energy for being activated when electrical energy passes from said source of electrical energy to said clutch means; said clutch means being positioned between said drive shaft of said motor assembly and said linkage for disconnecting said linkage from said drive shaft of said motor assembly when the force required to move said door increases above a certain amount and for completely disconnecting said linkage means from said drive shaft of said motor assembly in the event not electrical energy passes from said source of electrical energy to said clutch means, said drive train including variable torque control means for varying said certain amount of force required before said clutch means disconnects said linkage from said drive shaft of said motor assembly.

12. The combination of claim 11 in which said drive train includes gear means for being driven by said motor assembly and for driving said linkage.

13. The combination of claim 12 in which said gear means includes a driven shaft for being coupled to said drive shaft of said motor assembly, and a main drive shaft for being coupled to said linkage.

14. The combination of claim 12 in which said motor assembly includes a variable speed direct current motor, and in which said operator includes battery backup power means for operating said motor in the event of a power failure.

* * * * *